US007682712B2

(12) United States Patent
Liu et al.

(10) Patent No.: US 7,682,712 B2
(45) **Date of Patent: *Mar. 23, 2010**

(54) STABILITY POLYMERIC LUBRICANTS AND THIN FILM RECORDING MEDIA COMPRISING SAME

(75) Inventors: Jianwei Liu, Fremont, CA (US); Michael Joseph Stirniman, Fremont, CA (US); Jing Gui, Fremont, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 488 days.

This patent is subject to a terminal disclaimer.

(21) Appl. No.: 11/297,384

(22) Filed: Dec. 9, 2005

(65) Prior Publication Data

US 2006/0089275 A1 Apr. 27, 2006

Related U.S. Application Data

(62) Division of application No. 10/326,095, filed on Dec. 23, 2002, now Pat. No. 6,995,121.

(60) Provisional application No. 60/391,376, filed on Jun. 24, 2002.

(51) Int. Cl.
*G11B 5/66* (2006.01)

(52) U.S. Cl. ..... 428/835.8; 428/421

(58) Field of Classification Search ..... None
See application file for complete search history.

(56) References Cited

U.S. PATENT DOCUMENTS

| | | | |
|---|---|---|---|
| 2,564,646 | A | 8/1951 | Leistner et al. |
| 2,997,454 | A | 8/1961 | Leistner et al. |
| 3,039,993 | A | 6/1962 | Friedman et al. |
| 3,047,608 | A | 7/1962 | Friedman et al. |
| 3,053,878 | A | 9/1962 | Friedman et al. |
| 3,306,855 | A | 2/1967 | Borecki |
| 3,516,963 | A | 6/1970 | Friedman et al. |
| 3,558,554 | A | 1/1971 | Kuriyama et al. |
| 3,567,802 | A | 3/1971 | Garth |
| 3,760,038 | A | 9/1973 | Lewis |
| 4,187,212 | A | 2/1980 | Zinke et al. |
| 4,233,207 | A | 11/1980 | Spivack |
| 4,282,141 | A | 8/1981 | Minagawa et al. |
| 4,431,556 | A | 2/1984 | Christian et al. |
| 4,454,349 | A | 6/1984 | Tamborski et al. |
| 4,526,918 | A | 7/1985 | Burton |
| 4,701,375 | A | 10/1987 | Nishimatsu et al. |

(Continued)

OTHER PUBLICATIONS

Crompton Product Documents,www.uniroyalchemical.com/servlet/ ContentServer?pagenam..., pp. 4.

(Continued)

*Primary Examiner*—Holly Rickman

(57) ABSTRACT

A data/information storage and retrieval medium comprises:

(a) a substrate having a layer stack thereon, the layer stack including an outer surface and comprising at least one magnetic or magneto-optical ("MO") recording layer; and (b) a thin film or layer of a lubricant on the outer surface of the layer stack and comprised of a derivatized perfluoropolyether-based material including at least one generally linear perfluoropolyether chain and at least one phosphite antioxidant/stabilizer moiety attached to at least one end of at least one the chain.

6 Claims, 1 Drawing Sheet

U.S. PATENT DOCUMENTS

| | | | |
|---|---|---|---|
| 4,789,913 | A | 12/1988 | Gregory et al. |
| 5,077,424 | A | 12/1991 | Hanayama et al. |
| 5,376,465 | A | 12/1994 | Saibara et al. |
| 5,385,961 | A | 1/1995 | Avakian et al. |
| 5,399,276 | A | 3/1995 | Benjamin et al. |
| 5,453,539 | A | 9/1995 | Kondo et al. |
| 5,480,694 | A | 1/1996 | Daimon et al. |
| 5,489,480 | A | 2/1996 | Usuki et al. |
| 5,562,965 | A | 10/1996 | Gui et al. |
| 5,587,217 | A | 12/1996 | Chao et al. |
| 5,674,927 | A | 10/1997 | Mahood |
| 5,718,942 | A | 2/1998 | Vurens et al. |
| 5,874,169 | A | 2/1999 | Falcone |
| 5,908,817 | A | 6/1999 | Perettie et al. |
| 5,922,415 | A | 7/1999 | Dearnaley et al. |
| 6,001,446 | A | 12/1999 | Nakada et al. |
| 8,031,685 | | 2/2000 | French et al. |
| 6,183,831 | B1 | 2/2001 | Hughes et al. |
| 6,184,187 | B1 | 2/2001 | Howell et al. |
| 6,214,410 | B1 | 4/2001 | Stirniman et al. |
| 6,235,689 | B1 | 5/2001 | Falcone |
| 6,294,627 | B1 | 9/2001 | Worm et al. |
| 6,355,300 | B1 | 3/2002 | Stirniman et al. |
| 6,511,702 | B1 | 1/2003 | Stirniman et al. |
| 6,517,691 | B1 | 2/2003 | Bluck et al. |
| 6,613,151 | B1 | 9/2003 | Stirniman et al. |
| 6,764,984 | B2 | 7/2004 | Beatty |
| 6,808,741 | B1 | 10/2004 | McLeod |
| 6,828,284 | B2 | 12/2004 | Howell et al. |
| 6,846,542 | B1 * | 1/2005 | Liu et al. ..... 428/64.2 |
| 6,919,001 | B2 | 7/2005 | Fairbairn et al. |
| 6,998,183 | B1 * | 2/2006 | Pirzada et al. ..... 428/833.3 |
| 7,146,710 | B2 | 12/2006 | Fong et al. |
| 7,361,380 | B1 | 4/2008 | Liu et al. |
| 2002/0114980 | A1 * | 8/2002 | Gunsel et al. ..... 428/695 |
| 2003/0073588 | A1 | 4/2003 | Howell et al. |
| 2003/0134151 | A1 * | 7/2003 | Usuki et al. ..... 428/693 |
| 2008/0236481 | A1 | 10/2008 | Petersen et al. |
| 2008/0241366 | A1 | 10/2008 | Petersen et al. |
| 2008/0241367 | A1 | 10/2008 | Petersen et al. |

OTHER PUBLICATIONS

Antioxidants Product Information, www.cromptoncorp.com, pp. 4.

USPTO Restrict. Requirement Dated Jan. 6, 2005 for U.S. Appl. No. 10/326,095.

USPTO Non-Final Office Action Dated Apr. 19, 2005 for U.S. Appl. No. 10/326,095.

USPTO Notice of Allowance Dated Sep. 23, 2005 for U.S. Appl. No. 10/326,095.

USPTO Non-Final Office Action Dated Mar. 17, 2004 for U.S. Appl. No. 10/326,155.

USPTO Notice of Allowance Dated Sep. 24, 2004 for U.S. Appl. No. 10/326,155.

* cited by examiner

STABILITY POLYMERIC LUBRICANTS AND THIN FILM RECORDING MEDIA COMPRISING SAME

CROSS-REFERENCE TO RELATED APPLICATIONS

This application is a divisional of U.S. patent application Ser. No. 10/326,095, filed Dec. 23, 2002 now U.S. Pat. No. 6,995,121 which in turn claims priority from U.S. provisional patent application Ser. No. 60/391,376 filed Jun. 24, 2002, the disclosures of which Applications are incorporated by reference herein.

FIELD OF THE INVENTION

The present invention relates to polymeric lubricants having improved chemical stability, and to thin film data/information storage and retrieval media comprising thin films of same as a lubricant topcoat for reducing static and dynamic frictional coefficients of the media when utilized in combination with a flying head read/write transducer. The invention enjoys particular utility in the manufacture and use of thin film type magnetic or magneto-optical ("MO") recording media comprising a stacked plurality of thin film layers formed on a substrate, e.g., a disk-shaped substrate, wherein a thin topcoat layer comprised of a polymeric lubricant is applied to the upper surface of the layer stack for improving tribological performance of the media when utilized with read/write transducer heads operating at very low flying heights.

BACKGROUND OF THE INVENTION

Magnetic and MO media are widely employed in various applications, particularly in the computer industry for data/information storage and retrieval purposes. A magnetic medium in, e.g., disk form, such as utilized in computer-related applications, comprises a non-magnetic disk-shaped substrate, e.g., of glass, ceramic, glass-ceramic composite, polymer, metal, or metal alloy, typically an aluminum (Al)-based alloy such as aluminum-magnesium (Al—Mg), having at least one major surface on which a layer stack or laminate comprising a plurality of thin film layers constituting the medium are sequentially deposited. Such layers may include, in sequence from the substrate deposition surface, a plating layer, e.g., of amorphous nickel-phosphorus (Ni—P), a polycrystalline underlayer, typically of chromium (Cr) or a Cr-based alloy such as chromium-vanadium (Cr—V), a magnetic layer, e.g., of a cobalt (Co)-based alloy, and a protective overcoat layer, typically of a carbon (C)-based material, e.g., diamond-like carbon ("DLC") having good tribological properties. A similar situation exists with MO media, wherein a layer stack or laminate is formed on a substrate deposition surface, which layer stack or laminate typically comprises a reflective layer, e.g., of a metal or metal alloy, one or more rare-earth thermo-magnetic (RE-TM) alloy layers, one or more transparent dielectric layers, and a protective overcoat layer, e.g., a DLC layer, for functioning as reflective, transparent, writing, writing assist, and read-out layers, etc.

Thin film magnetic and MO media in disk form, such as described supra, are typically lubricated with a thin topcoat film or layer comprised of a polymeric lubricant, e.g., a perfluoropolyether, to reduce wear of the disc when utilized with data/information recording and read-out transducer heads operating at low flying heights, as in a hard disk system functioning in a contact Start/Stop ("CSS") mode. Conventionally, the thin film of lubricant is applied to the disc surface (s) during manufacture by dipping into a bath containing a small amount of lubricant, e.g., less than about 1% by weight of a fluorine-containing polymer, dissolved in a suitable solvent, typically a perfluorocarbon, fluorohydrocarbon, or hydrofluoroether.

Thin film magnetic recording media are conventionally employed in disk form for use with disk drives for storing large amounts of data in magnetizable form. Typically, one or more disks are rotated on a central axis in combination with data transducer heads. In operation, a typical contact start/stop ("CSS") cycle commences when the head begins to slide against the surface of the disk as the disk begins to rotate. Upon reaching a predetermined high rotational speed, the head floats in air at a predetermined distance from the surface of the disk due to dynamic pressure effects caused by the air flow generated between the sliding surface of the head and the disk. During reading and recording operations, the transducer head is maintained at a controlled distance from the recording surface, supported on a bearing of air as the disk rotates, such that the head can be freely moved in both the circumferential and radial directions, allowing data to be recorded on and retrieved from the disk at a desired position. Upon terminating operation of the disk drive, the rotational speed of the disk decreases and the head again begins to slide against the surface of the disk and eventually stops in contact with and pressing against the disk. Thus, the transducer head contacts the recording surface whenever the disk is stationary, accelerated from the static position, and during deceleration just prior to completely stopping. Each time the head and disk assembly is driven, the sliding surface of the head repeats the cyclic sequence consisting of stopping, sliding against the surface of the disk, floating in air, sliding against the surface of the disk, and stopping.

For optimum consistency and predictability, it is necessary to maintain each transducer head as close to its associated recording surface as possible, i.e., in order to minimize the flying height of the head. Accordingly, a smooth recording surface is preferred, as well as a smooth opposing surface of the associated transducer head. However, if the head surface and the recording surface are too flat, the precision match of these surfaces gives rise to excessive stiction and friction during the start up and stopping phases, thereby causing wear to the head and recording surfaces, eventually leading to what is referred to as a "head crash." Thus, there are competing goals of reduced head/disk friction and minimum transducer flying height.

The lubricity properties of disk-shaped recording media are generally measured and characterized in terms of dynamic and/or static coefficients of friction. The former type, i.e., dynamic friction coefficient, is typically measured utilizing a standard drag test in which the drag produced by contact of a read/write transducer head with a disk surface is determined at a constant spin rate, e.g., 1 rpm. The latter type, i.e., static coefficients of friction (also known as "stiction" values), are typically measured utilizing a standard contact start/stop ("CSS") test in which the peak level of friction is measured as the disk starts rotating from zero (0) rpm to a selected revolution rate, e.g., 7,200 rpm. After the peak friction has been measured, the disk is brought to rest, and the start/stop process is repeated for a selected number of start/stop cycles. An important property of a disk which is required for good long-term disk and drive performance is that the disk retain a relatively low coefficient of friction after many start/stop cycles or contacts with the read/write transducer head, e.g., 20,000 start/stop cycles.

According to conventional practices, a lubricant topcoat is uniformly applied over the protective overcoat layer to prevent wear between the disk and the facing surface of the read/write transducer head during CSS operation because excessive wear of the protective overcoat layer increases friction between the transducer head and the disk, eventually leading to catastrophic failure of the disk drive. However, an excess amount of lubricant at the head-disk interface causes high stiction between the head and the disk, which stiction, if excessive, prevents starting of disk rotation, hence catastrophic failure of the disk drive. Accordingly, the lubricant thickness must be optimized for stiction and friction.

The continuing requirements for increased recording density and faster data transfer rates necessitating lower flying heights of the data transducing heads and friction/stiction of the head-disk interface have served as an impetus for the development of specialized lubricants for serving as the lubricant topcoat layer overlying the protective overcoat layer. Such lubricants are required to fulfill a variety of functions requiring diverse characteristics and attributes. For example, the lubricant material forming the topcoat layer must be chemically inert, have a low vapor pressure, low surface tension, high thermal stability, mechanical stability under shear stress, and good boundary lubrication properties. In addition to the foregoing, it is critical that the lubricant adhere tightly to the underlying surface, i.e., the protective overcoat layer (typically carbon-based) over the lifetime of the disk drive comprising the recording disk and associated flying head data transducer.

Fluoropolyether lubricants have been developed which are in widespread use as materials for forming the lubricant topcoat layers of disk-shaped data/information storage and retrieval media, e.g., magnetic and MO recording media. Fluoropolyether-based lubricants are uniquely suited for use as lubricant topcoat layers in such rotating disk-type recording media in view of their exemplary properties, including inter alia, chemical inertness, low vapor pressure, low surface tension, high thermal stability, mechanical stability under high shear stress, and good boundary lubrication properties. Among the many currently available fluoropolyether lubricants, liquid perfluoropolyethers (PFPE) and derivatives thereof are most commonly employed in forming lubricant topcoat layers on rotatable recording media.

Commercially available PFPE lubricants include KRYTOX™ (DuPont Co., Wilmington, Del.); FOMBLIN™ Z-DOL, Z-TETRAOL, Z-DOL TXS, AM 2001, and AM 3001 (Ausimont Montedison Group, Thorofare, N.J.); and DEMNUM™ SA, SH, SP, and SY (Daikin Industries, Ltd., Osaka, Japan). A number of these commercially available PFPE-based lubricants are substituted with 2 to 4 polar end-groups, such as 2-4 hydroxyl or carboxyl groups, which polar end-groups are provided for enhancing adhesion of the polymeric lubricant molecules to the surface of the recording media, e.g., the surface of a carbon-based protective overcoat layer. Application of the PFPE-based lubricants to the media surface may be performed by any standard technique, e.g., dipping, spraying, spin coating, etc., followed by drying to remove any volatile solvent(s) therefrom, and if desired, followed by tape burnishing. A more recently developed technique for applying thin films of polymeric lubricants to media surfaces comprises generation of a vapor of the lubricant followed by condensation of the vapor on the media surface.

As indicated above, conventional PFPE-based lubricants generally comprise 2-4 polar groups or moieties at either end of a generally linear perfluorinated alkylpolyether molecule, for facilitating direct bonding to a surface, and thus, provide improved adhesion of the lubricant topcoat layer to the surface of the protective overcoat layer. Such polar functional groups, however, are not necessarily chemically inert, i.e., they may exhibit varying degrees of chemical inertness, and consequently, the above-described conventional PFPE-based lubricants may disadvantageously undergo chemical reactions prior or subsequent to their application to the media surface. In particular, contamination of the lubricant topcoat layer with a Lewis acid, e.g., aluminum oxide ($Al_2O_3$), may promote rapid degradation of the lubricant topcoat layer.

As a consequence of such concerns and problems associated with the chemical stability of derivatized PFPE lubricant materials utilized as topcoat layers in rotatable disk recording media, decomposition resistance of the lubricant is an important criterion in lubricant selection, particularly resistance against acid-catalyzed decomposition.

One approach which has been investigated for mitigating the problem of acid-catalyzed lubricant decomposition of PFPE-based lubricants is to include a small amount of a "Hindered Amine Light Stabilizer" ("HALS") compound to the solution utilized for applying the lubricant topcoat layer by dipping techniques. However, addition of a HALS compound to solutions of conventional PFPE lubricants and derivatives thereof incurs a number of problems and drawbacks, including inter alia, phase separation, hazing, and decreased tribological performance. Further, the very low solubility of the HALS compound in the PFPE molecules results in incorporation of a very amount of the HALS compound in the lubricant topcoat layer, and as a consequence, the effect on protecting the PFPE-based lubricant molecules from chemical reaction, e.g., acid-catalyzed decomposition, is negligible.

Another approach for improving the performance of the most commonly employed lubricants utilized with thin film, disk-shaped magnetic and MO media, i.e., perfluoropolyether ("PFPE")-based lubricants, which lubricants perform well under ambient conditions but not under conditions of higher temperature and high or low humidity, is described in, for example, U.S. Pat. No. 5,587,217, the entire disclosure of which is incorporated herein by reference, wherein it is disclosed that studies indicate that the tribological properties, and perhaps corrosion resistance, of perfluoropolyether-based lubricants utilized in the manufacture of thin film recording media can be substantially improved by addition thereto of an appropriate amount of a cyclotriphosphazene-based lubricant additive, e.g., a polyphenoxy cyclotriphosphazene comprising substituted or unsubstituted phenoxy groups, to form what is termed a "composite lubricant".

Currently, bis (4-fluorophenoxy)-tetrakis (3-trifluoromethyl phenoxy) Cyclotriphosphazene (available as X-1P™ from Dow Chemical Co., Midland, Mich.) is the additive most commonly utilized with perfluoropolyether-based lubricants for forming composite lubricants for use with thin film magnetic and MO media. However, as disclosed in U.S. Pat. Nos. 5,718,942 and 5,908,817, the disclosures of which are incorporated herein by reference, the use of X-1P as a lubricant additive for forming composite lubricants comprising the perfluoropolyether-based lubricants commonly employed in the data storage industry (e.g., Fomblin Z-DOL™ and Fomblin Z-TETRAOL™, each available from Ausimont, Thorofare, N.J.) incurs a disadvantage in that the former (i.e., the cyclotriphosphazene-based lubricant additive) has very low solubility in the latter (i.e., the PFPE-based primary lubricant), resulting in phase separation and droplet formation.

Still another approach for improving the performance of the most commonly employed lubricants utilized with thin film, disk-shaped magnetic and MO media, i.e., perfluoropolyether ("PFPE")-based lubricants is the addition of antioxidant/stabilizer materials to solutions of the PFPE-based lubricants. However, while such additions have been found to be very effective in retarding chemical degradation of the PFPE-based lubricant thin films, the addition of such antioxidant/stabilizer materials incurs a number of problems, including phase separation, hazing, and poor tribological performance, especially with ultra-thin lubricant films.

Thus, a significant factor in evaluating the performance of candidate lubricant materials for use as lubricant topcoat layers in rotatable recording media is the ability of the lubricant to resist chemical decomposition over time, particularly acid-catalyzed decomposition, while not deleteriously affecting critical or requisite lubricant properties. In view of the criticality of the lubricant topcoat in obtaining and maintaining optimum performance of rotating disk recording media utilized with flying head read/write transducers operating at very low flying heights, there is a continuing need for lubricant materials and topcoat layers exhibiting improved chemical and physical durability, corrosion resistance, adhesion, stiction and wear performance, etc., particularly under conditions of high stress, temperature, and humidity.

DISCLOSURE OF THE INVENTION

An advantage of the present invention is a lubricant composition having improved stability and antioxidant properties.

Another advantage of the present invention is a data/information storage retrieval medium including a lubricant topcoat layer having improved stability and antioxidant properties.

Yet another advantage of the present invention is a method of manufacturing a data/information storage retrieval medium including a lubricant topcoat layer having improved stability and antioxidant properties.

Still another advantage of the present invention is a method of synthesizing a lubricant compound having improved stability and antioxidant properties.

A further advantage of the present invention is an improved data/information storage retrieval medium.

Additional advantages and other aspects and features of the present invention will be set forth in the description which follows and in part will become apparent to those having ordinary skill in the art upon examination of the following or may be learned from the practice of the present invention. The advantages of the present invention may be realized and obtained as particularly pointed out in the appended claims.

According to an aspect of the present invention, the foregoing and other advantages are obtained in part by a lubricant composition comprising a derivatized perfluoropolyether-based material including at least one generally linear perfluoropolyether chain and at least one phosphite antioxidant/stabilizer moiety attached to at least one end of at least one said chain.

According to embodiments of the present invention, the perfluoropolyether-based material includes a phosphite antioxidant/stabilizer moiety at each end of the at least one chain; and according to further embodiments of the invention, the perfluoropolyether-based material includes a pair of generally linear perfluoropolyether chains and a phosphite antioxidant/stabilizer moiety is attached to at least one end of each chain.

Preferred embodiments of the present invention are those wherein the at least one phosphite antioxidant/stabilizer moiety is an organophosphite moiety; organophosphite moiety is attached to the at least one end of the at least one chain via a chemical bond between a reactive group at the end of the chain and a the phosphorus atom of the organophosphite moiety; the at least one organophosphite moiety is derived from an organophosphite compound having at least one aromatic group bonded to an oxygen atom, e.g., the at least one organophosphite moiety is derived from an organophosphite compound selected from the group consisting of tris (2,4 di-butylphenoxy)phosphite, tris (mono-fluorophenoxy) phosphite, and tris (mono-trifluoromethylphenoxy)phosphite; the at least one generally linear perfluoropolyether chain comprises a plurality of —$(C_xF_{2x}O)_n$— repeating units, wherein x in each unit is independently an integer from about 1 to about 10 and n is an integer from about 10 to about 30; and the generally linear perfluoropolyether chain comprises at least one reactive group selected from ester (—COOR), alcohol (—COH), carboxylic acid (—COOH), and carboxylic chloride (—COCl) groups at the at least one end of the chain.

In accordance with particular embodiments of the invention, the lubricant composition further comprises a solvent for the derivatized perfluoropolyether-based material.

Another aspect of the present invention is a data/information storage and retrieval medium, comprising:

(a) a substrate having a layer stack thereon, the layer stack including an outer surface and comprising at least one magnetic or magneto-optical ("MO") recording layer; and (b) a thin film or layer of a lubricant on the outer surface of the layer stack and comprised of a derivatized perfluoropolyether-based material including at least one generally linear perfluoropolyether chain and at least one phosphite antioxidant/stabilizer moiety attached to at least one end of at least one chain.

According to certain embodiments of the present invention, the perfluoropolyether-based material includes a phosphite antioxidant/stabilizer moiety at each end of the at least one chain; whereas according to certain other embodiments of the invention, the perfluoropolyether-based material includes a pair of generally linear perfluoropolyether chains and a phosphite antioxidant/stabilizer moiety is attached to at least one end of each chain.

Preferred embodiments of the present invention include those where the at least one phosphite antioxidant/stabilizer moiety is an organophosphite moiety, the organophosphite moiety is attached to the at least one end of the at least one chain via a chemical bond between a reactive group at the at least one end of the chain and the phosphorus atom of the organophosphite moiety; the at least one organophosphite moiety is derived from an organophosphite compound having at least one reactive aromatic group bonded to an oxygen atom, e.g., the at least one organophosphite moiety is derived from an organophosphite compound selected from the group consisting of tris (2,4 di-butylphenoxy)phosphite, tris (mono-fluorophenoxy)phosphite, and tris (mono-trifluoromethylphenoxy)phosphite; the generally linear perfluoropolyether chain comprises a plurality of —$(C_xF_{2x}O)_n$— repeating units, wherein x in each unit is independently an integer from about 1 to about 10 and n is an integer from about 10 to about 30; generally linear perfluoropolyether chain comprises at least one reactive group selected from ester (—COOR), alcohol (—COH), carboxylic acid (—COOH), and carboxylic chloride (—COCl) groups at the at least one end of the chain; and the substrate is annular disk-shaped and the outer surface of said layer stack comprises a carbon (C)-based protective overcoat material.

Yet another aspect of the present invention is a method of manufacturing a data/information storage and retrieval medium, comprising steps of:

(a) providing a substrate having a layer stack thereon, the layer stack including an outer surface and comprising at least one magnetic or magneto-optical ("MO") recording layer; and (b) forming a thin film or layer of a lubricant on the outer surface of the layer stack, the lubricant being comprised of a derivatized perfluoropolyether-based material including at least one generally linear perfluoropolyether chain and at least one phosphite antioxidant/stabilizer moiety attached to at least one end of at least one chain.

According to embodiments of the present invention, step (b) comprises forming a thin film or layer of said lubricant wherein the perfluoropolyether-based material includes a phosphite antioxidant/stabilizer moiety at each end of the at least one chain; whereas, according to other embodiments of the present invention, step (b) comprises forming a thin film or layer of the lubricant wherein said perfluoropolyether-based material includes a pair of generally linear perfluoropolyether chains and a phosphite antioxidant/stabilizer moiety is attached to at least one end of each chain.

Preferred embodiments of the invention include those wherein step (b) comprises forming a thin film or layer of the lubricant wherein the derivatized perfluoropolyether-based material includes at least one organophosphite moiety as the phosphite antioxidant/stabilizer moiety; the at least one organophosphite moiety is attached to the at least one end of the at least one chain via a chemical bond between a reactive group at the end of the chain and the phosphorus atom of the organophosphite moiety; the at least one organophosphite moiety is derived from an organophosphite compound having at least one reactive aromatic group bonded to an oxygen atom, e.g., the at least one organophosphite moiety is derived from an organophosphite compound selected from the group consisting of tris (2,4 di-butylphenoxy)phosphite, tris (mono-fluorophenoxy)phosphite, and tris (mono-trifluoromethylphenoxy)phosphite; the generally linear perfluoropolyether chain comprises a plurality of —$(C_xF_{2x}O)_n$— repeating units, wherein x in each unit is independently an integer from about 1 to about 10 and n is an integer from about 10 to about 30, and the generally linear perfluoropolyether chain comprises at least one reactive group selected from ester (—COOR), alcohol (—COH), carboxylic acid (—COOH), and carboxylic chloride (—COCl) groups at the at least one end of the chain; and step (a) comprises providing an annular disk-shaped substrate and the outer surface of said layer stack comprises a carbon (C)-based protective overcoat material.

Still another aspect of the present invention is a method of synthesizing a derivatized perfluoropolyether-based material useful as a lubricant stabilized against corrosion and catalyzed decomposition when utilized as a thin film lubricant layer of a thin film data/information storage and retrieval medium, comprising steps of:

(a) providing a precursor perfluoropolyether material including a generally linear perfluoropolyether chain having a reactive group at at least one end of the chain; and (b) reacting the at least one reactive group at at least one end of at least one chain with the phosphorus atom of a phosphite antioxidant/stabilizer compound to form a derivatized perfluoropolyether-based material including at least one generally linear perfluoropolyether chain and at least one phosphite antioxidant/stabilizer moiety attached to at least one end of at least one chain.

According to embodiments of the present invention, step (b) comprises reacting a reactive group at each end of the chain of the precursor with the phosphorus atom of a phosphite antioxidant/stabilizer compound; whereas, according to other embodiments of the invention, step (b) comprises reacting a reactive group of each of a pair of precursors with the phosphorus atom of a phosphite antioxidant/stabilizer compound.

Preferred embodiments of the present invention include those wherein step (a) comprises providing a precursor including a generally linear perfluoropolyether chain having at least one reactive group selected from ester (—COOR), alcohol (—COH), carboxylic acid (—COOH), and carboxylic chloride (—COCl) groups at the at least one end of the chain; and step (b) comprises reacting the at least one reactive group of the precursor with an organophosphite compound having at least one aromatic group bonded to an oxygen atom; e.g., step (a) comprises providing a precursor having a generally linear perfluoropolyether chain comprised of a plurality of —$(C_xF_{2x}O)_n$— repeating units, wherein x in each unit is independently an integer from about 1 to about 10 and n is an integer from about 10 to about 30; and step (b) comprises reacting the at least one reactive group of the precursor with an organophosphite compound selected from the group consisting of tris (2,4 di-butylphenoxy)phosphite, tris (mono-fluorophenoxy)phosphite), and tris (mono-trifluoromethylphenoxy phosphite).

A still further aspect of the present invention is a data/information storage and retrieval medium, comprising:

(a) a substrate having a layer stack thereon, the layer stack including an outer surface and comprising at least one magnetic or magneto-optical ("MO") recording layer; and (b) antioxidant stabilizing means for lubricating the outer surface of the layer stack.

Additional advantages and aspects of the present invention will become readily apparent to those skilled in the art from the following detailed description, wherein embodiments of the present invention are shown and described, simply by way of illustration of the best mode contemplated for practicing the present invention. As will be described, the present invention is capable of other and different embodiments, and its several details are susceptible of modification in various obvious respects, all without departing from the spirit of the present invention. Accordingly, the drawings and description are to be regarded as illustrative in nature, and not as limitative.

BRIEF DESCRIPTION OF THE DRAWINGS

The following detailed description of the embodiments of the present invention can best be understood when read in conjunction with the following drawings, wherein.

DESCRIPTION OF THE INVENTION

Figure 1:
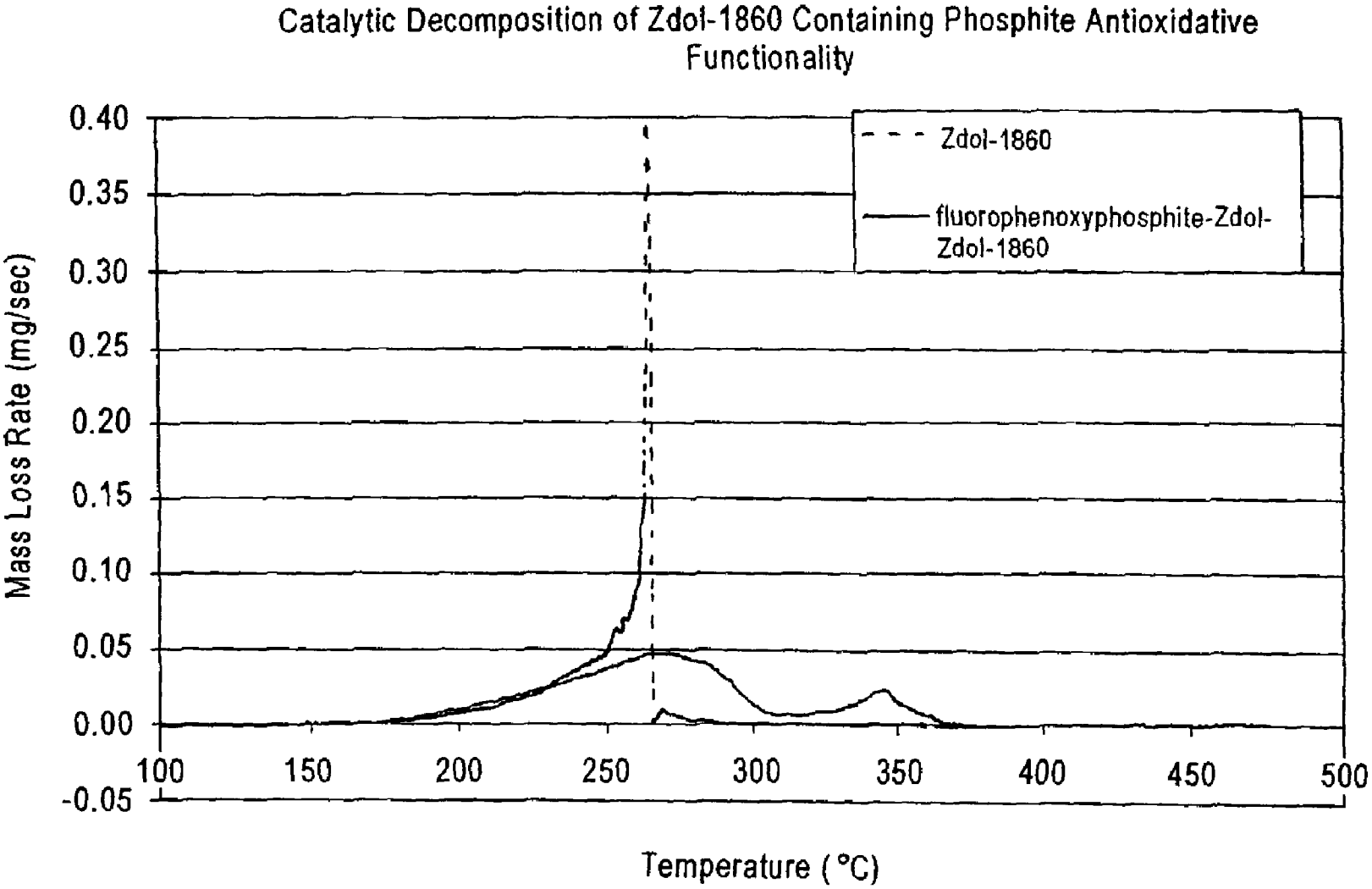
FIG. 1 is a graph for comparing the thermogravimetric mass loss rate of a conventional linear perfluoropolyether lubricant and a phosphite-derivatized linear perfluoropolyether lubricant according to the invention.

The present invention is based upon the discovery by the present inventors that the above-described problems, drawbacks, and disadvantages associated with the use of perfluoropolyether-based lubricant materials in the manufacture and use of thin film magnetic and/or MO recording media, e.g., in the form of hard disks, arising from the incomplete chemical inertness thereof resulting in chemical decomposition reactions prior or subsequent to their application to the media surface, particularly catalyzed decomposition reactions, can be eliminated, or at least substantially mitigated, by forming and utilizing derivatized, generally linear chain perfluoropolyether-based lubricants incorporating at least one phosphite antioxidant/stabilizer moiety at at least one end of the chain.

The inventive methodology, wherein derivatized perfluoropolyether-based lubricant materials comprising at least one phosphite antioxidant/stabilizer moiety within the lubricant molecules rather than in admixture therewith (i.e., as an additive to the lubricant solution applied to the media surface), advantageously overcomes the difficulties, drawbacks, and disadvantages associated with the latter approach, including inter alia, phase separation, hazing, and degraded tribological performance when the lubricant layer is ultra-thin. Moreover, the derivatized perfluoropolyether-based lubricant materials comprising at least one phosphite antioxidant/stabilizer moiety according to the present invention are easily synthesized from readily available, generally linear chain perfluoropolyether-based precursor materials having at least one reactive end group at at least one end thereof and from equally readily available or synthesizable phosphite antioxidant/stabilizer compounds which include a phosphorus atom or group for reaction with the reactive end group(s) of the perfluoropolyether-based precursor materials. In addition, the derivatized perfluoropolyether-based lubricant materials comprising at least one phosphite antioxidant/stabilizer moiety according to the present invention are conveniently applied as thin lubricant topcoat layers of thin film magnetic and/or MO recording media by means of conventional techniques and methodologies, e.g., as by dipping the media surface into a solution of the derivatized lubricant material in a suitable solvent, and the thus-produced lubricant films or layers exhibit substantially increased resistance to catalyzed decomposition and friction, stiction, and tribological performance characteristics at least comparable to those of conventional perfluoropolyether-based lubricant materials.

According to the present invention, therefore, stability of linear chain perfluoropolyether-based lubricants utilized in the manufacture and use of thin film magnetic and/or MO recording media in disk form, particularly against catalyzed decomposition reactions, is significantly improved by synthetic attachment of at least one phosphite antioxidant/stabilizer moiety to at least one end of at least one generally linear perfluoropolyether ("precursor"). As utilized herein and elsewhere (see, e.g., U.S. Pat. Nos. 3,039,993; 3,047,608; 3,558,554; 4,187,212; 4,282,141; 5,077,424; 5,385,961; and 5,674,927, the entire disclosures of which are incorporated herein by reference thereto), organophosphite compounds exhibiting antioxidant/stabilizer activity comprise, in their simplest form, tertiary phosphites including a central phosphorous (P) atom with three surrounding oxygen (O) atoms each bonded to an organic group R, i.e., $(R—O)_3—P$, wherein the three R groups may be the same or different.

Suitable organophosphite antioxidant/stabilizer compounds for use in the present invention typically, but not exclusively, include identical R groups, and frequently comprise an aromatic R group moiety, e.g., a phenyl group, and therefore organophosphite compounds containing phenyl groups and alkylphenyl groups such as methylphenyls, ethylphenyls, and tert-butyl phenyls are usable according to the invention. Organophosphite antioxidant/stabilizer compounds containing fluorine-substituted phenyls, e.g., fluorophenyls and trifluoromethylphenyls are advantageous according to the invention in view of the reduction in surface energy, hence increased water contact angles ("WCA") they afford.

By way of illustration, but not limitation, examples of suitable organophosphite antioxidant/stabilizer compounds for use in the present invention include:

tris (2,4 di-butylphenoxy)phosphite ("TBPP")

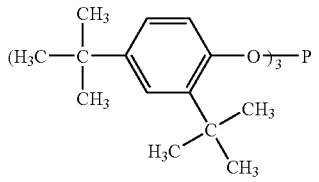

tris (mono-fluorophenoxy)phosphite

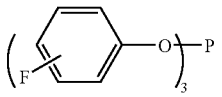

and tris (mono-trifluoromethylphenoxy)phosphite

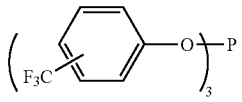

Of these, TBPP is commercially available from Sigma-Aldrich, Milwaukee, Wis., and the fluorophenoxy phosphite antioxidant/stabilizer compounds may be readily synthesized by reaction of fluoro phenol or trifluoromethyl phenol with phosphorous trichloride ($PCl_3$) in a suitable solvent, e.g., triethylamine ($Et_3N$), as follows:

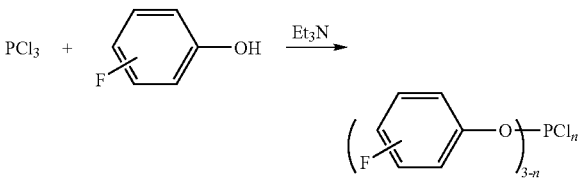

where n=0, 1, or 2, depending upon the molar ratio of the reaction components.

Generally linear perfluoropolyether compounds usable as precursor compounds according to the invention comprise a plurality of $—(C_xF_{2x}O)_n—$ repeating units, wherein x in each unit is independently an integer from 1 to about and n is an integer from about 10 to about 30, with at least one reactive group selected from ester (—COOR), alcohol (—COH), carboxylic acid (—COOH), and carboxylic chloride (—COCl) groups at at least one end of the chain. Several such precursor compounds including these reactive end groups and suitable for use according to the invention are available from Ausimont Montedison Group, Thorofare, N.J. and include Z-Deal (with —COOR end groups), Z-Dol (with —COH groups), and Z-Diac (with —COOH end groups). The perfluoropolyether derivatives with carboxylic chloride (—COCl) end groups for use as precursor compounds according to the present invention are readily prepared from Z-Diac according to conventional synthetic practices.

According to the invention, phosphite-derivatized perfluoropolyether materials are synthesized by effecting reaction between the reactive end groups of the precursor linear perfluoropolyether compound and the phosphorus atom of the phosphite antioxidant/stabilizer compound. By way of illustration, but not limitation, the above-described tris (2,4 di-butylphenoxy)phosphite antioxidant/stabilizer compounds may be reacted with Z-Dol (with —COH reactive end groups), as follows:

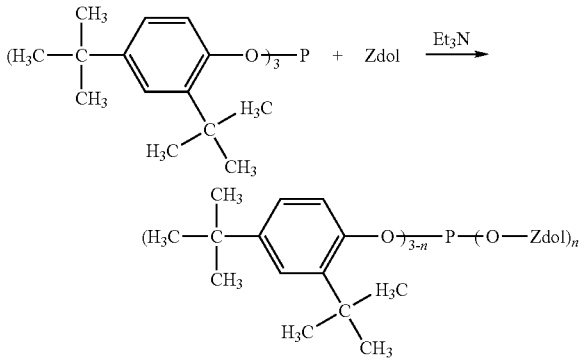

where n=1 or 2.

Similarly, tris (mono-fluorophenoxy)phosphite, and tris (mono-trifluoromethylphenoxy)phosphite antioxidant/stabilizer compounds may be reacted with Z-Dol (with —COH reactive end groups) as follows:

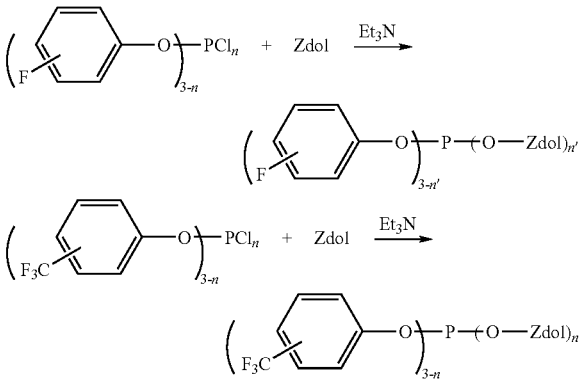

where n=0, 1, or 2 and n'=1 or 2.

Typically, and by non-limitative example, the above indicated reactions are allowed to proceed at room temperature for about 2 hrs. In each instance, the resultant is neutralized with aqueous 0.5 N HCl, and the reaction product extracted therefrom using Vertrel VF. The Vertrel VF is then removed, as by rotary vacuum distillation, to yield a clear oil. The clear oil crude product is then eluted through a silica gel column, and washed with additional Vertrel VF to remove any residual salts, phenol, and Z-Dol. The Vertrel VF is then removed, e.g., by evaporation, to yield a clear oil product. Finally, a Supercritical Fluid Extraction process is performed on the clear oil for further purification and extraction.

According to the invention, the central phosphorus (P) atom of the phosphite antioxidant/stabilizer moiety is bonded, via an —O— linkage, to the ends of 1 or 2 linear perfluoropolyether compounds, and each end of the 1 or 2 linear perfluoropolyether compounds may be bonded to a phosphite antioxidant/stabilizer moiety. While not wishing to be bound by any particular theory, it is nonetheless believed that the presence of the phosphite moiety within the perfluoropolyether-based lubricant material reduces the formation and concentration of free radicals over an extended period. It is further believed that the phosphite moiety has a greater antioxidation capability than the phosphate moiety, and therefore, while the perfluoropolyether main chain provides good lubricity and tribological properties, the phosphite moiety provides an even better defense against catalyzed decomposition than is possible with the phosphate moiety, thereby effectively stabilizing both the lubricant and the carbon-based protective overcoat and minimizing the likelihood of head crashing.

Thin lubricant films of the phosphite-derivatized perfluoropolyether compounds according to the invention can be applied to the upper surface of thin film magnetic and/or MO recording media, typically in disk form and comprising an uppermost C-based protective overcoat layer, by any conventional technique, e.g., submerging the disk in a solution comprising the derivatized perfluoropolyether compound in a suitable solvent, withdrawing the disk from the solution, and evaporating the solvent therefrom to form a thin film or layer of the phosphite-derivatized lubricant on the surface of the protective overcoat layer.

FIG. 1 is a graph for comparing the thermogravimetric mass loss rate of a conventional linear perfluoropolyether lubricant (Z-Dol-1860) and a fluorophenoxyphosphite-derivatized linear perfluoropolyether lubricant according to the invention, wherefrom it is readily apparent that the addition of the fluorophenoxyphosphite moiety to the Z-Dol results in a dramatic reduction in the mass loss rate (relative to the underivatized Z-Dol) and increased thermal stability.

CSS friction/stiction tests performed under high humidity, i.e., 80% relative humidity, indicated that disks comprising a lubricant layer formed of derivatized Z-Dol with at least one phosphite antioxidant/stabilizer moiety attached to at least one end of the Z-Dol linear chain exhibited a 100% pass rate for 20,000 CSS cycles, whereas similar disks with lubricant layers formed of underivatized Z-Dol exhibited only a 75% passing rate.

The present invention thus provides a number of advantages over conventional methodology utilizing conventional perfluoropolyether-based lubricant films utilized in the manufacture and use of disk-shaped, thin film magnetic and/or MO recording media, and is of particular utility in automated manufacturing processing of thin film magnetic and MO recording media requiring formation of stable and durable lubricant topcoat layers for obtaining improved tribological properties. Specifically, the present invention provides for significantly increased thermal stability and resistance of the lubricant topcoat layer to catalyzed decomposition, compared to conventional perfluoropolyether-based lubricant thin films. Further, the inventive methodology can be readily practiced and utilized as part of conventional recording media manufacturing technology in view of its full compatibility with all other aspects of automated manufacture of disk-shaped magnetic and MO media. Finally, the inventive methodology is broadly applicable to the manufacture of a number of different products, e.g., mechanical parts, gears, linkages, etc., requiring lubrication.

In the previous description, numerous specific details are set forth, such as specific materials, structures, processes, etc., in order to provide a better understanding of the present invention. However, the present invention can be practiced without resorting to the details specifically set forth. In other instances, well-known processing materials, structures, and techniques have not been described in detail in order not to unnecessarily obscure the present invention.

Only the preferred embodiments of the present invention and but a few examples of its versatility are shown and described in the present invention. It is to be understood that the present invention is capable of use in various other embodiments and is susceptible of changes and/or modifications within the scope of the inventive concept as expressed herein.

What is claimed is:

1. A data/information storage and retrieval medium, comprising:

(a) a substrate having a layer stack thereon, said layer stack including an outer surface and comprising at least one magnetic or magneto-optical ("MO") recording layer; and (b) a thin film or layer of a lubricant on said outer surface of said layer stack and comprised of a derivatized perfluoropolyether-based material including at least one generally linear perfluoropolyether chain and at least one organophosphite moiety attached to at least one end of at least one said chain via a chemical bond between a reactive group at said at least one end of said chain and the phosphorus atom of said organophosphite moiety, wherein said at least one organophosphite moiety is derived from an organophosphite compound selected from the group consisting of tris (2,4 di-butylphenoxy) phosphite, tris (mono-fluorophenoxy)phosphite, and tris (mono-trifluoromethylphenoxy)phosphite.

2. The medium according to claim 1, wherein:

said perfluoropolyether-based material includes a phosphite antioxidant/stabilizer moiety at each end of said at least one chain.

3. The medium according to claim 1, wherein:

said perfluoropolyether-based material includes a pair of generally linear perfluoropolyether chains and a said phosphite antioxidant/stabilizer moiety is attached to at least one end of each chain.

4. The medium according to claim 1, wherein:

said generally linear perfluoropolyether chain comprises a plurality of —(CxF2xO)n- repeating units, wherein x in each unit is independently an integer from about 1 to about 10 and n is an integer from about 10 to about 30.

5. The medium according to claim 4, wherein:

said generally linear perfluoropolyether chain comprises at least one reactive group selected from ester (—COOR), alcohol (—COH), carboxylic acid (—COOH), and carboxylic chloride (—COCl) groups at said at least one end of said chain.

6. The medium as in claim 1, wherein said substrate is annular disk-shaped and said outer surface of said layer stack comprises a carbon (C)-based protective overcoat material.

* * * * *